US005329701A

United States Patent [19]

Schultz et al.

[11] Patent Number: 5,329,701

[45] Date of Patent: Jul. 19, 1994

[54] TOOL FOR CUSTOM FITTING SLIP-ONS TO GOLF SHOES AND A METHOD OF USE THEREFOR

[76] Inventors: Gregory A. Schultz, 229 Ritteu House Road, Kitchener, Ontario, Canada, N2E 2V3; Mark E. Weber, 224 Ritteu House Road, Kitchner, Ontario, Canada, N2E 2V5

[21] Appl. No.: 69,387

[22] Filed: Jun. 1, 1993

[51] Int. Cl.[5] ..... B26B 3/00

[52] U.S. Cl. ..... 30/316; 12/142 EV; 36/7.3; 36/127; 223/113

[58] Field of Search ..... 30/316, 358; 29/432; 83/30; 223/113; 36/7.2, 7.3, 7.4, 127; 12/142 EV

[56] References Cited

U.S. PATENT DOCUMENTS

| | | | |
|---|---|---|---|
| 2,785,481 | 3/1957 | Joseph | 36/7.3 |
| 3,486,248 | 12/1969 | Olson et al. | 36/7.3 |
| 3,763,578 | 10/1973 | Chadwell | 36/7.3 |
| 4,338,733 | 7/1982 | Frechins | 36/7.3 |

*Primary Examiner*—Douglas Watts
*Attorney, Agent, or Firm*—Daryl W. Schnurr

[57] ABSTRACT

A tool is used to custom fit rubber slip-ons onto golf shoes for use in wet conditions to keep the feet of the golfer dry. The tool can be manually manipulated to cut openings into the sole of a slip-on of an appropriate size so that the openings are aligned with the spikes of the golf shoe. When openings have been cut for all of the spikes, the sole of the slip-on rests against a base of the spikes and the sole of the golf shoe. The tool has an elongated hollow body with two ends. One end has a circular cutting edge thereon and the other end has a handle thereon. After the slip-on is placed onto the golf shoe with the spikes separating the sole of the slip-on from the sole of the golf shoe, the tool is aligned with each spike in turn to cut an appropriate opening for that spike. Previously, slip-ons have been designed with pre-cut openings but these slip-ons can only be used with a specific model of golf shoe of a specific manufacturer having a specific size.

2 Claims, 2 Drawing Sheets

TOOL FOR CUSTOM FITTING SLIP-ONS TO GOLF SHOES AND A METHOD OF USE THEREFOR

BACKGROUND OF THE INVENTION

1. Field of the Invention

This invention relates to a tool for fastening slip-ons to golf shoes and a method of use therefor. More particularly, this invention relates to a tool for manually cutting openings into a sole of slip-ons to accommodate spikes of golf shoes.

2. Description of the Related Art

Golf is rapidly increasing in popularity and in those geographical areas where golf cannot be played in winter, avid golfers try to extend the season as long as possible. These golfers play golf from the early Spring to the late Fall. These golfers also play golf in all kinds of weather including wet or rainy conditions. When it is raining or areas of the course are wet or soggy, water leaks through golf shoes worn by the golfer and the golfer becomes extremely uncomfortable, particularly when the weather is cold. These conditions often cause the golfer to terminate the game prematurely or cause a lack of concentration.

It is known that golf shoes can be kept substantially dry under wet conditions by installing slip-ons (which are usually made of flexible rubber material) to the shoes, said slip-ons having pre-formed holes therein to accommodate the spikes. Golf shoes of different manufacturers or of different sizes have spikes located in different locations. Slip-ons are generally available in small, medium and large sizes so that one size fits all within a fairly broad range. Thus, if a slip-on with pre-formed openings in the sole is desired, the slip-ons must be cut differently for each size, for each model and for each manufacturer of golf shoes. This design requirement is highly impractical. A retailer must keep a large inventory of pre-cut slip-ons to have slip-ons for all of the golf shoes sold by the retailer. Also, when the openings are pre-formed, they are often made too large and water can seep into an interior of the slip-on through the pre-formed openings. Or, one or more spikes on the golf shoes is not properly located and the slip-ons must be stretched by an extraordinary amount to fit the shoe, thereby enlarging the opening still further and making the slip-ons difficult to remove. Obviously, once the pre-formed openings are cut, the slip-ons have a limited use.

SUMMARY OF THE INVENTION

It is an object of the present invention to provide a tool that can be used manually to custom fit a slip-on to a golf shoe by making openings in the sole of the slip-on that correspond to spikes on the golf shoe.

A tool custom fits slip-ons to golf shoes, the shoes having a plurality of spikes extending outward from a sole thereof, the slip-on also having a sole. The tool has an elongated body with two ends, a first end having a circular cutting edge thereon said cutting edge having a depth at least slightly greater than a depth of a thickness of the sole of said slip-on. The cutting edge is sized to fit over one spike.

A method of custom fitting a slip-on having a sole to a golf shoe having a sole with a plurality of spikes extending outward from said sole of said golf shoe, each spike having a base, said method using a tool having an elongated hollow body with two ends, a first end having a circular cutting edge thereon, a second end having a handle, said cutting edge being sized to fit over one spike, said method comprising the steps of stretching the slip-on over the golf shoe with the shoe of the slip-on aligned with the sole of the golf shoe but spaced apart therefrom because of said spikes, grasping said tool by said handle and aligning a longitudinal axis of said tool with a longitudinal axis of one spike so that a cutting edge of said tool can surround said one spike, forcing the tool towards said one spike, thereby cutting a small opening in said sole of said slip-on, said opening being aligned with said one spike, said opening having a diameter that is substantially equal to a diameter of said one spike, forcing the tool further onto said one spike so that the sole of the slip-on rests against the base of said one spike, repeating the method for other spikes on said golf shoe until the sole of said slip-on rests against the base of each spike and against the sole of said golf shoe.

BRIEF DESCRIPTION OF THE DRAWINGS

In the drawings:

FIG. 2 is a sectional side view of a tool in use with a partial side view of a golf shoe and a partial sectional view of a slip-on;

DESCRIPTION OF A PREFERRED EMBODIMENT

Figure 1:
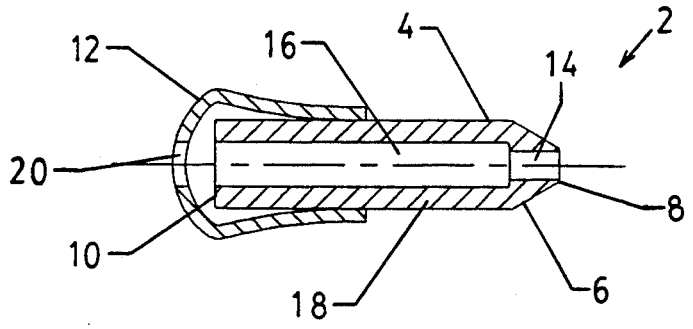
FIG. 1 is a sectional side view of a tool.

In FIG. 1, it can be seen that a tool 2 has an elongated hollow body 4 with two ends. A first end 6 has a circular cutting edge 8 and a second end 10 has a handle 12 thereon. A cylindrical first passage 14 extends from the cutting edge 12 towards the second end 10 and has a smaller cross-sectional diameter than a second passage 16 in a main portion 18 of the elongated body 4. The handle 12 has a hole 20 therein which, preferably, has a larger diameter than the diameter of the first passage 14. The purpose of the hole 20 is to allow circular cut-outs (not shown) from said slip-on to pass through the first passage 14, through the second passage 16 and out of the tool through the hole 20. The hole 20 is preferred but not necessary. When the handle does not have a hole (i.e. FIG. 3), the cut-outs can be removed simply by removing the handle.

Various materials can be used for the elongated body but, preferably, the elongated body is made of heat treated tool steel. The handle 12 can also be made of various materials but is preferably made of rubber or similar material. The tool could be easily designed so that the handle is integral with the elongated body.

Golf shoes and slip-ons are conventional. Slip-ons are usually made of rubber or similar stretchable, resilient and water-proof material.

Figure 2:
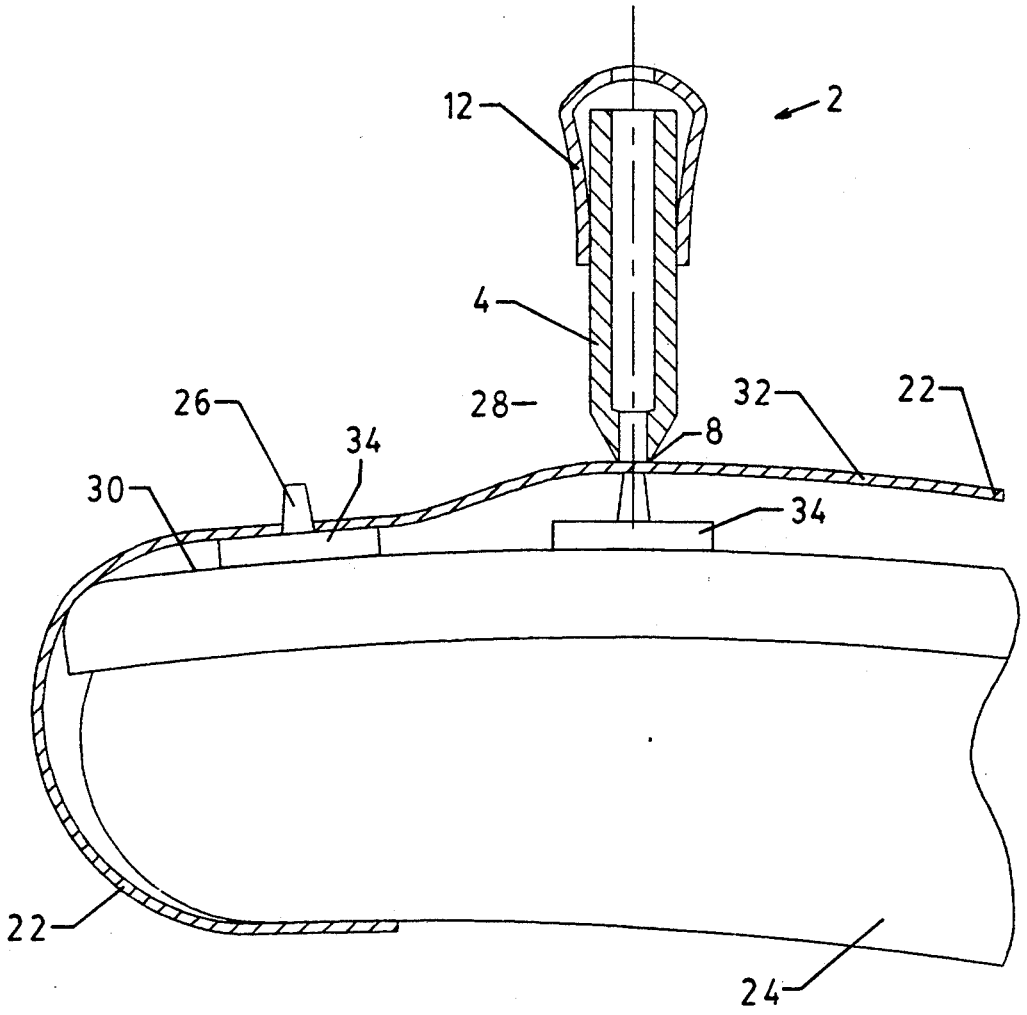
Figure 3:
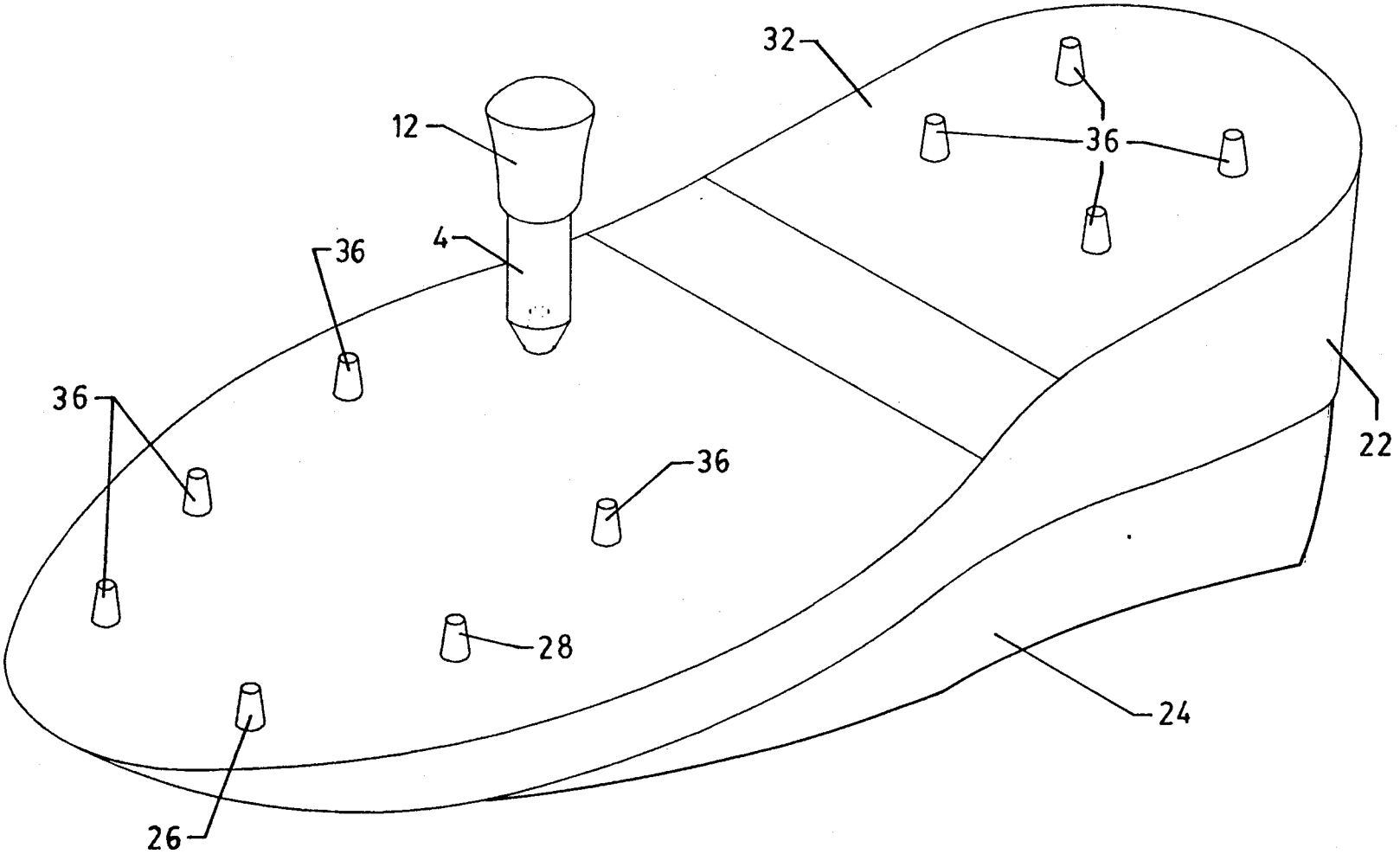
FIG. 3 is a perspective view of said tool being used with a slip-on and a golf shoe.

In FIG. 2, the tool 2 is used with a slip-on 22 and a golf shoe 24. The golf shoe has a first spike 26 and a second spike 28 extending outward from a sole 30 thereof. The slip-on 22 has a sole 32, which is aligned with, but spaced apart from, the sole 30 of the shoe 24 by the spikes. In FIG. 2, the tool 2 has already been used to cut an opening in the sole 32 of the slip-on for the first spike 26 and the first spike rests against a base 34 of said first spike 26. The tool 2 has a longitudinal axis that is concentric with a longitudinal axis of the second spike 28. In this position, the tool 2 can be manually forced downward onto the spike 28, thereby cutting an opening into the sole 32 of the slip-on 22 and forcing the sole against the base 34 of the second spike 28. Preferably, the tool is rotated so that the cutting edge 8 moves clockwise and counterclockwise when the tool is being forced onto a spike. This method can be repeated for the other spikes on the golf shoe so that ultimately openings are cut in the sole 32 of the slip-on 22 to receive all of the spikes of the golf shoe 24. When this occurs, the remaining spikes 36 will protrude through the sole 32 as shown in FIG. 3.

Since the openings are cut into the sole at the specific location of each spike and since the circular cutting edge is designed so that it only has a diameter that is slightly larger than at least a portion of each spike, the slip-on tightly surrounds each spike so that water will not easily pass through the openings in the sole 32 when the slip-on is completely installed on the golf shoe. Preferably, the cutting edge is large enough so that the tool can be forced onto each spike until the cutting edge is adjacent to the base.

During wet conditions, the slip-ons can be placed on the golf shoes to keep the feet of a golfer dry and, as conditions improve, the slip-ons can be easily removed. After all of the openings are cut, the slip-ons are custom fitted to a particular set of golf shoes and the slip-ons can repeatedly be installed on and removed from the same set of golf shoes. The slip-ons are custom cut for the golf shoes for which they are used and therefore the tool can be used to affix any slip-on of an appropriate general size onto any golf shoe. There is no need to pre-cut the slip-ons and a proper alignment of the openings with the spikes of a particular shoe is always assured. A retailer need only stock slip-ons in the three general sizes of small, medium and large to have a sufficient supply for any set of golf shoes. Also, since the slip-ons are not pre-cut, their use is not limited to a particular set of golf shoes. The slip-ons can still be sold by the retailer for use with conventional shoes (i.e. without spikes).

What we claim as our invention is:

1. A method of custom fitting a slip-on having a sole to a golf shoe having a sole with a plurality of spikes extending outward from said sole of said golf shoe, each spike having a base, said method using a tool having an elongated hollow body with two open ends, a first end having a circular cutting edge thereon, a second end having a handle, said cutting edge being sized to fit over one spike, said method comprising the steps of stretching the slip-on over the golf shoe with the sole of the slip-on aligned with the sole of the golf shoe but spaced apart therefrom because of said spikes, grasping said tool by said handle and aligning a longitudinal axis of said tool with a longitudinal axis of one spike so that a cutting edge of said tool can surround said one spike, forcing the tool towards said one spike, thereby cutting a small opening in said sole of said slip-on said opening being aligned with said one spike, said opening having a diameter that is substantially equal to a diameter of said one spike, forcing the tool further onto said one spike so that the sole of the slip-on rests against the base of said one spike, repeating the method for other spikes on said golf shoe until the sole of said slip-on rests against the base of each spike and against the sole of said golf shoe.

2. A method as claimed in claim 1 wherein the tool is forced onto said spike while manually rotating said tool to move said cutting edge clockwise and counterclockwise.

* * * * *